US005163762A

United States Patent [19]

Murakami

[11] Patent Number: 5,163,762

[45] Date of Patent: Nov. 17, 1992

[54] DRIVING CIRCUIT FOR SOLENOID HEAD OF A PRINTER

[75] Inventor: Atsushi Murakami, Nagoya, Japan

[73] Assignee: Brother Kogyo Kabushiki Kaisha, Aichi, Japan

[21] Appl. No.: 564,153

[22] Filed: Aug. 7, 1990

[30] Foreign Application Priority Data

Aug. 9, 1989 [JP] Japan ..... 1-206032

[51] Int. Cl.[5] ..... B41J 2/30

[52] U.S. Cl. ..... 400/124; 400/157.2

[58] Field of Search ..... 400/124, 157.2, 157.3; 101/93.05

[56] References Cited

U.S. PATENT DOCUMENTS 4,473,311 9/1984 Sakaida ..... 400/124

5,071,269 12/1991 Yamada et al. ..... 400/124

FOREIGN PATENT DOCUMENTS

0226388A2 12/1986 European Pat. Off. ..... 400/124

224762 12/1983 Japan ..... 400/124

253456 10/1989 Japan ..... 400/124

*Primary Examiner*—David A. Wiecking

*Attorney, Agent, or Firm*—Kane, Dalsimer, Sullivan, Kurucz, Levy, Eisele and Richard

[57] ABSTRACT

In a printing head, which is employable in a printer, having a predetermined number of printing pins respectively connected to solenoids circularly disposed along a predetermined circle, the solenoids being arranged to be connected to another predetermined number of transistor arrays respectively including third predetermined number of transistor; the improvement in that two solenoids adjacently located with each other along the predetermined circle are respectively connected to separate transistor arrays. Thus, the current flowed through the solenoids can be prevented from undesirably increasing.

17 Claims, 6 Drawing Sheets

DRIVING CIRCUIT FOR SOLENOID HEAD OF A PRINTER

BACKGROUND OF THE INVENTION

The present invention relates to a solenoid head driving circuit of a printer, more particularly to a solenoid head driving circuit capable of preventing current flowing through the solenoid from undesirably increasing.

Referring to FIG. 1, a structure of a printing head of a wire dot matrix printer conventionally used will be described hereinafter. In a casing 82 of a printing head 81, a large number of comb shaped teeth 83, for example, 24, in FIG. 1, in a particular pitch are disposed in circumferential. On the comb shaped teeth 83, a solenoid coil 84 is wound, and thus, a solenoid is structured. At the end of an armature 85 which is driven by the solenoid, printing pins 86 are disposed.

FIG. 2A is a conceptual schematic showing positional relationship among the solenoids 1 through 24 on a typical solenoid head. In the meantime, a semi-conductor element comprising a package in which a plurality of transistor chips are housed is called "transistor array" hereinafter. FIG. 2B is a schematic showing conventionally used connections between the solenoids 1 through 24 and transistor arrays 70*a* through 70*f*. Conventionally, as shown in FIG. 2B, when the transistor arrays 70*a* through 70*f* are connected to the solenoids 1 through 24, for example, one transistor array 70*a* is connected to four solenoids 2, 4, 6, and 8 which are adjacently disposed as shown in FIG. 2A.

However, when printing pins which are adjacently disposed are simultaneously driven by driving the solenoids adjacently disposed, as shown in FIG. 3, an amount of current which flows through in one solenoid is proportional to the number of adjacently disposed solenoids "S" which are driven at a time due to magnetic effect. In other words, a magnet field which is generated by the current flowing through a certain solenoid generates current flowing the solenoid adjacently located with the certain solenoid in the same direction of the current having been flowed through the adjacent solenoid, and then, the current flowing the adjacent solenoid is increased. Thus, in the conventional structure where the four solenoids adjacently disposed are connected to transistors of one transistor array, when only the four solenoids are always driven so as to execute a printing operation, an amount of current which flows through each of solenoids respectively increase. The total amount of current which flows through the four solenoids becomes larger than the 4 times of current which flows through a solenoid when one printing pin is driven. Thus, even if no duty limit is applied because of low printing duty, an excessive load is applied to one transistor array, resulting in problems with respect to safety and life of the product.

SUMMARY OF THE INVENTION

It is therefore an object of the invention to provide an improved solenoid head driving circuit of a printer wherein an excessive load is shared to a plurality of transistor arrays rather than to one transistor array so as to execute a safe and long life operation.

For this purpose, according to the present invention, there is provided a printing head, which is employable in a printer, having a predetermined number of printing pins respectively connected to solenoids circularly disposed along a predetermined circle, said solenoids being arranged to be connected to another predetermined number of transistor arrays respectively including third predetermined number of transistor;

the improvement in that two solenoids adjacently located with each other along said predetermined circle are respectively connected to separate transistor arrays.

With the above described arrangement, the transistors included in the same transistor array are connected to solenoids which are not adjacently disposed with each other. Thus, even if a plurality of solenoids which are adjacently disposed are driven at a time, an excessive load which may occur is shared to each of transistors respectively included in a plurality of transistor arrays, and then, the undesired excessive current is not flowed in one transistor array.

DECRIPTION OF THE ACCOMPANYING DRAWINGS

DESCRIPTION OF THE EMBODIMENTS

Referring to the attached drawings, an embodiment of the present invention will be described hereinafter.

Figure 1:
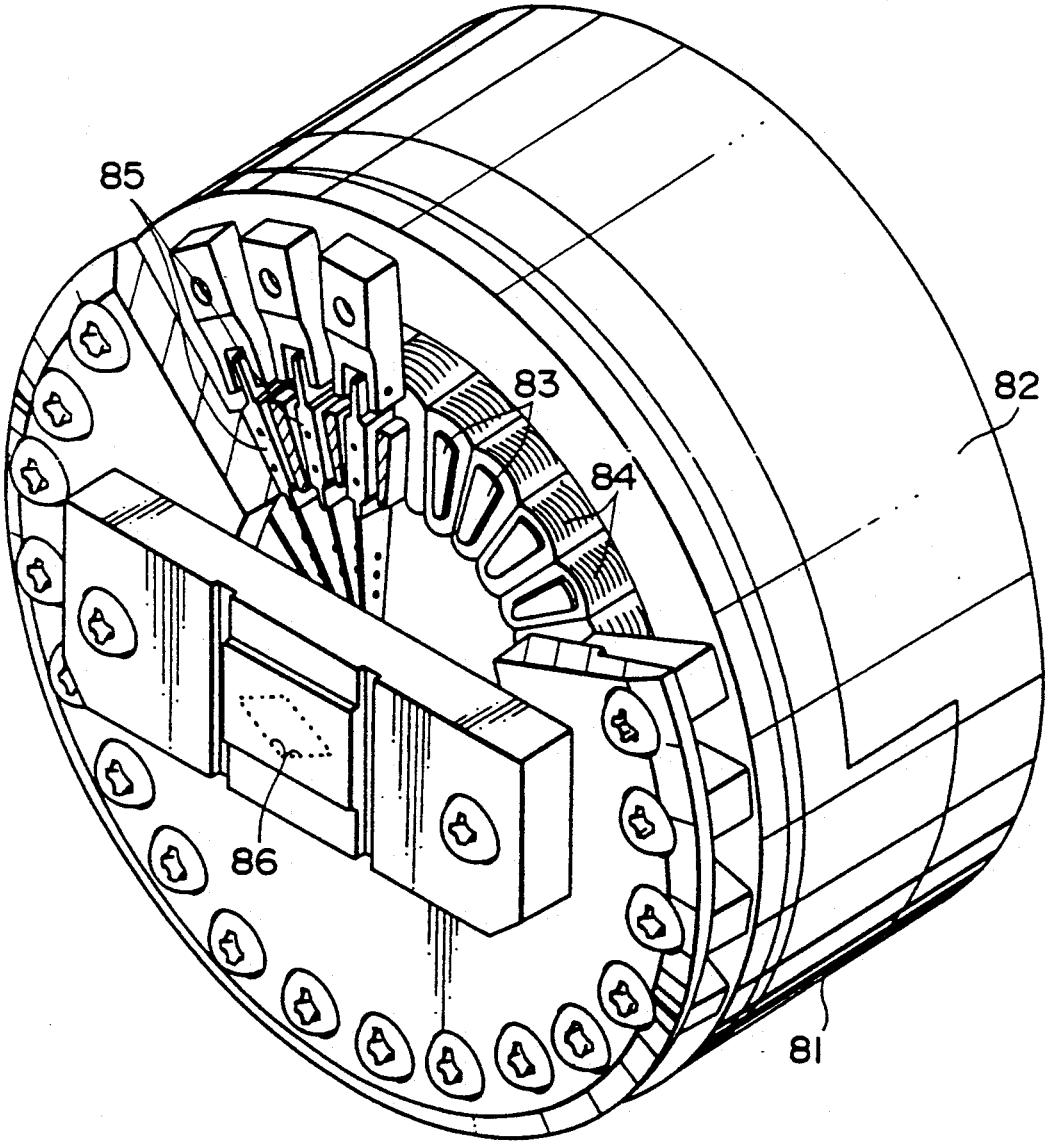
FIG. 1 is a perspective view showing part of a printing head of a wire dot matrix printer to which the present invention is applied.

The structure of the printing head of the wire dot matrix printer according to the present invention is the same as that of the prior art shown in FIG. 1.

Then, a method for connecting transistors of the same transistor array to solenoids according to a particular rule will be exemplified by using mathematical expressions.

When assuming that the number of the solenoids, i.e., printing pins or all of the transistors are "N" and the number of transistors in one transistor array is "n", the value "N/n" where "N" is divided by "n" represents the number of transistor arrays. Now, when expressing the divisor of "N/n" by K [1], K [m−1], K [m−2], . . . , K [1], K [0], (K [m]=N/n, K [0]=1), the below-described relationships are obtained, i) when the number of divisors is even (m=21−l, where l: any natural number):

$$
\begin{aligned}
N/n &= K[m] \times K[0] \\
&= K[m-1] \times K[1] \\
&= K[m-2] \times K[2] \\
&\ldots \\
&= K[(m+1)/2] \times K[(m-1/2]
\end{aligned}
$$

ii) when the number of divisors is odd (m=21, where l is any natural number):

$$
\begin{aligned}
N/n &= K[m] \times K[0] \\
&= K[m-1] \times K[1] \\
&= K[m-2] \times K[2] \\
&\ldots \\
&= K[m/2] \times K[m/2].
\end{aligned}
$$

The above expressed equations respectively have the following meanings.

Since "N/n" is expressed by K [m]×K [0], all of the solenoids are uniformly divided into K [0] (=1) portions, that is, all of the solenoids are treated as one portion. By connecting the transistors of the same transistor array to every K [m]−1 solenoid, that is, at intervals of K [m]−1 solenoids, the transistor array consisting of K [m](=N/n) transistors can be uniformly connected to all of the solenoids.

In addition, although all of the solenoids are uniformly divided into K [m] portions and then each of portions are connected to every K [0] (=1) transistor of the transistor array, that is, at intervals of K [0]−1(=0), that is, continuously connected without any space. However, this connection pattern is the same as the conventional pattern shown in FIG. 2B. When only "n" solenoids adjacently disposed are always driven to execute a printing operation, current which flows through each of solenoids increase because of the magnetic effect. Even if the printing duty is low and thereby no duty limit is applied, an excessive load is concentrated to such a transistor array, resulting in problems in view of safety and life of the printer. In addition, "N/n" can be also expressed by K [m−1]×K [1], K [m−2]×K [2], . . . , K [(m+1)/2]×K [(m−1)/2], K [m/2]×K [m/2], and so forth. In these combinations, like the combination of K [m]×K [0], a large number of transistor arrays can be uniformly connected to all of "N" solenoids.

Now, by referring to drawings of FIGS. 4A through 4D and FIG. 2A, a method for connecting 24 solenoids to six transistor arrays each of which consists of four transistors will be practically exemplified.

Figure 2A:
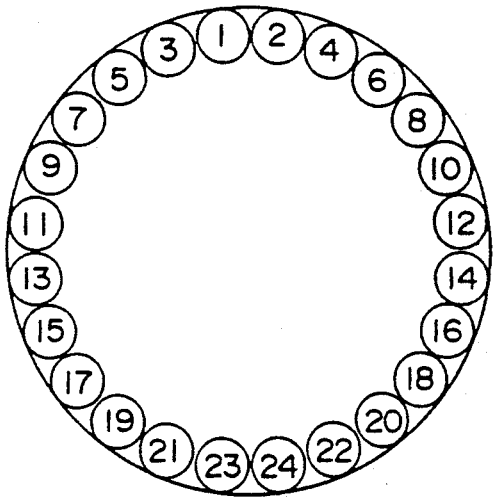
FIG. 2A PRIOR ART
FIG. 2A is a conceptual schematic showing the positional relationship among the solenoids incorporated in the printing head of FIG. 1.

As shown in FIG. 2A, the printing head contains 24 solenoids numbered 1 through 24. The solenoids 1 through 24 are categorized as those for even number pins and those for odd number pins which are disposed in circumferential. The quotient where the numeral 24 or the number of solenoids is divided by the numeral 4 or the number of transistors contained in one transistor array is 6. The divisors of numeral 6 are 6, 3, 2, and 1.

Figure 4A:
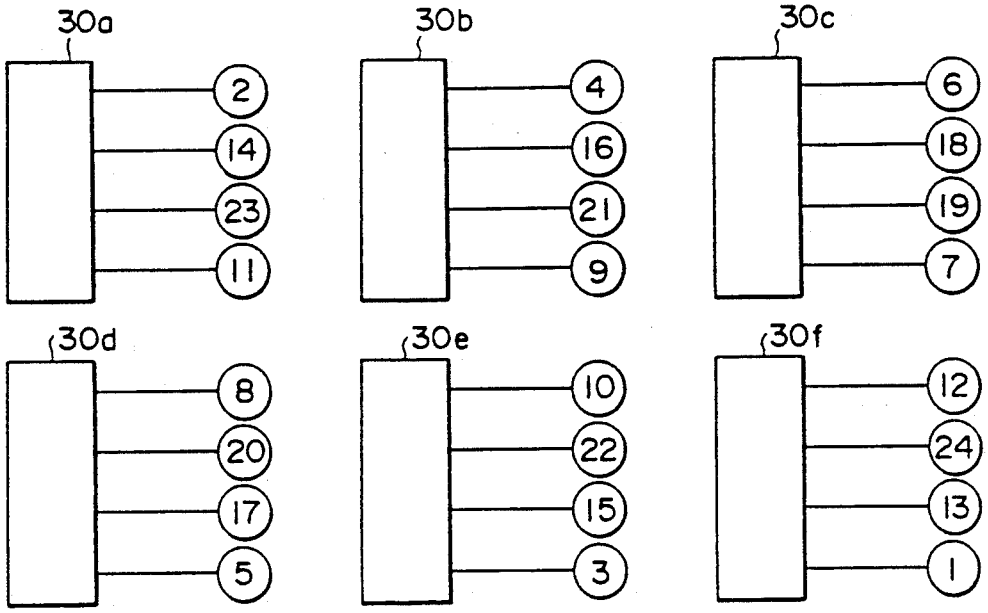
FIGS. 4A through 4D are schematics showing connections between transistor arrays and solenoids.

Since the numeral 6, i.e., the number of transistor arrays, is expressed by 6×1, when all the solenoids are treated as one portion and four transistors of the same transistor array are connected to every sixth solenoid, that is, at intervals of five (=6−1) solenoids (for example, as shown in FIG. 2A, the transistors of the transistor array 30*a* are connected to the solenoids 2, 14, 23, and 11), the six transistor arrays 30*a* to 30*f* can be uniformly connected to all of the solenoids as shown in FIG. 4A.

Figure 2B:
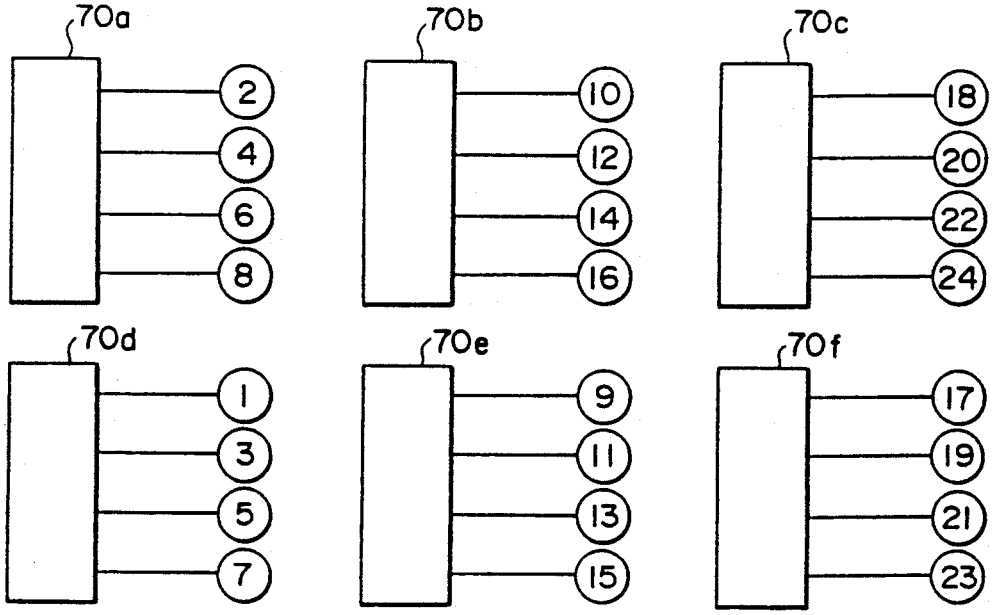
FIG. 2B PRIOR ART
FIG. 2B is a schematic showing connections of transistor arrays to solenoids in prior art.
Figure 3:
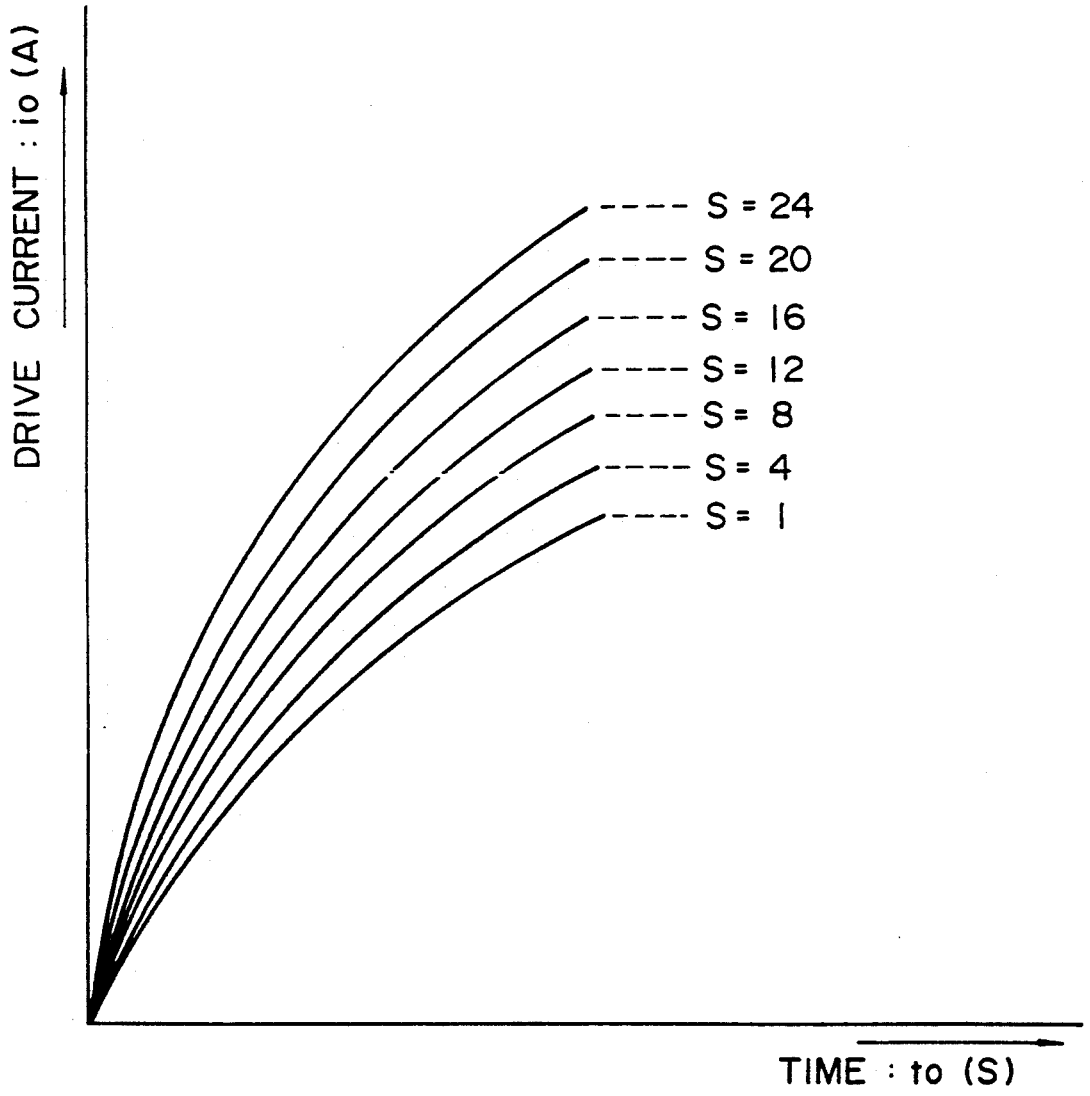
FIG. 3 is a schematic showing a relationship between the number of solenoids which are driven at a time and a waveform of current which flows through one solenoid.

In addition, it is also possible to uniformly divide all of the solenoids into six equivalent portions and continuously connect four transistors of the same transistor array to every first solenoid, that is, at no interval, that is, continuously as shown in FIG. 2B.

However, this connection pattern is the same as that of the prior art which results in problems.

Figure 4B:
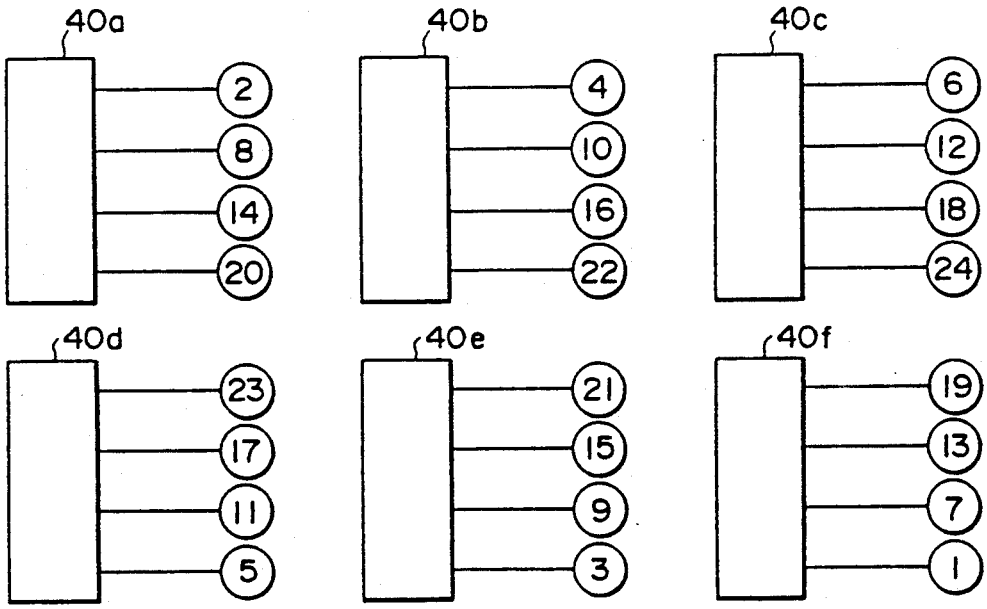

Moreover, since the numeral 6 is expressed by 3×2, when all of the solenoids are uniformly divided into two portions and four transistor of the same transistor array are connected to every third solenoid, that is, at intervals of two solenoids (=3−1), the three transistor arrays can be uniformly connected to one of two portions into which all the solenoids are uniformly divided. In other words, the three transistor arrays 40*a*, 40*b*, and 40*c* shown in FIG. 4B are uniformly connected to the right side half of the solenoids shown in FIG. 2A. The remaining three transistor arrays 40*d*, 40*e*, and 40*f* are uniformly connected to the left half of the solenoids shown in FIG. 2A. Thus, all of the transistor arrays 40*a* through 40*f* are uniformly connected to all of the solenoids.

Figure 4C:
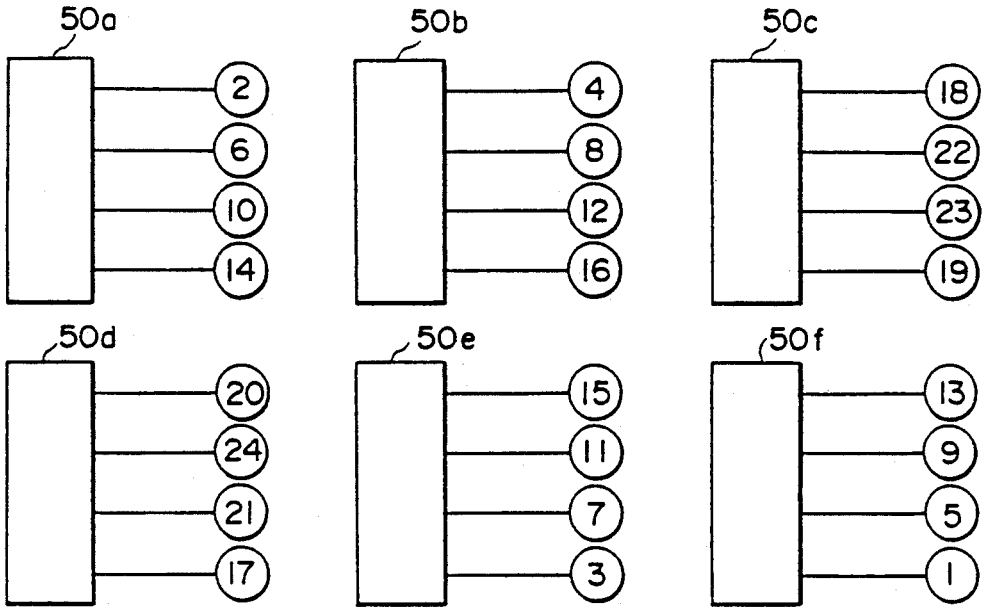

Likewise, when all of the solenoids are uniformly divided into three portions and four transistors of the same transistor array are connected to every second solenoid, that is, at intervals of one solenoid (=2−1), as shown in FIG. 4C, two transistor arrays can be uniformly connected to one of three solenoid portions in which all of the solenoids are uniformly divided. For example, the two transistor arrays 50*a* and 50*b* are uniformly connected to the upper right portion, which is one of three portions shown in FIG. 2A. The remaining four transistor arrays 50*c* through 50*f* are also uniformly connected to the remaining portions of the solenoids. Thus, all the transistor arrays 50*a* through 50*f* are uniformly connected to all of the solenoids.

Now, by referring to FIG. 2A and FIG. 4A, an operation of a solenoid head driving circuit according to the present embodiment will be described. An example where four transistors of each of six transistor arrays are connected to every sixth solenoid of 24 solenoids, that is, a case in which the intervals are five solenoids (=6−1) will be described.

When a printing operation is conducted in the state where only four solenoids at positions 2, 14, 23, and 11 connected to the transistor array 30*a* are always driven, since each solenoid is located at the farthest position each other, it is not almost affected by the magnetic effect and also the current which flows through each solenoid does not increase. Thus, no excessive load is applied to the transistor array 30*a*. On the other hand, in the printer according to the present embodiment, when the printing duty exceeds 20%, a duty limit where dots of one line printing are printed in several operations is applied to protect the head from being overloaded. However, since only four of 24 pins are used to print, the printing duty is 16.7% and thereby no duty limit is applied.

When only solenoids connected to one transistor array are always driven to execute the printing operation, although the duty limit does not take place, each solenoid does not cause the magnetic effect against other solenoids. Thus, an excessive load is not applied to the solenoid array.

When at least one side of solenoid pair 1 and 4, solenoid pair 12 and 16, solenoid pair 24 and 21, and solenoid pair 13 and 9, and one of solenoids 2, 14, 23, and 11 which are connected to the transistor array 30*a* are driven at a time, the latter solenoids at positions 2, 14, 23, and 11 are affected by the magnetic effect. For example, when the solenoid pair 1, 12, 24, and 13 and the solenoid pair 2, 14, 23, and 11 are always driven at a time, eight of 24 pins are used to execute the printing operation. Thus, each solenoid is affected by the magnetic effect and thereby the current which flows through each solenoid increases. Since the printing duty exceeds 20% and becomes 33%, the duty limit is applied. Consequently, an excessive load is not applied to the transistor array.

Figure 5:
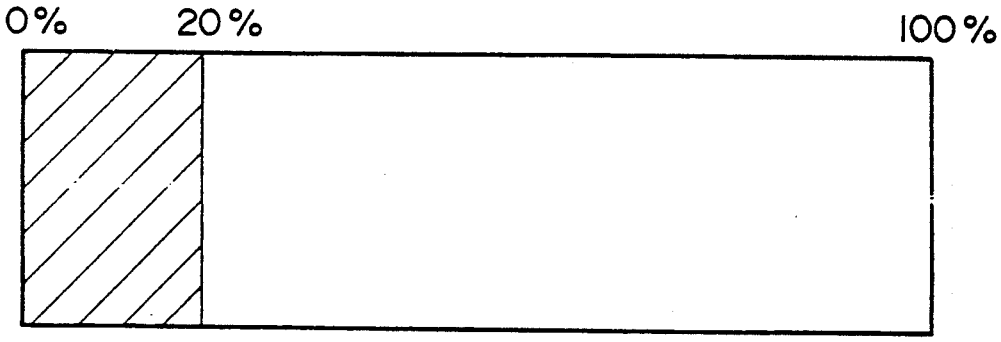
FIG. 5 is a schematic showing an example where a duty limit is not applied even if all dots are used for printing operation.

On the other hand, when an area of 20% or less of all of dots which used for the printing operation in a particular time period, i.e., hatched area in FIG. 5, is printed by driving all of the pins, since no duty limit is applied, an excessive load is applied to the transistor array. However, since the overload is only applied momentarily, the transistor array is not burdened with it.

Thus, in the conventional connecting method as shown in FIG. 2B, when only four solenoids connected to one transistor array are always driven to execute the printing operation, the current which flow through each of solenoid respectively increase. Thus, an excessive load is applied to the transistor array. To safely operate the transistor array, it is necessary to undesirably increase its rating of current capable of flowing through the transistor array, thereby raising the cost. However, in the connecting method according to the present embodiment as shown in FIG. 4A through 4C, when only four solenoids adjacently disposed are always driven to execute the printing operation, although the current which flows through each solenoid increases, since the adjacent four solenoids to be driven are connected to a plurality of transistor arrays rather than one transistor array, no excessive load is applied to the transistor arrays.

When nine solenoids are driven by two transistor arrays, each of which consists of four transistors, one solenoid remains. That is, when the number of solenoids is not divided by the number of transistors included in one transistor array, it is possible to connect an independent transistor to the remaining solenoid. Moreover, when a plurality of solenoids remain, it is possible to use transistor arrays whose number accords with that of the solenoids so that the adjacent solenoids are not connected to transistors in the same transistor array.

As described above, by methodically connecting transistors of the same transistor array to solenoids which are not adjacently disposed, since a load is uniformly shared to each transistor array, the rating of transistor arrays relating to current capable of flowing through the transistor array can be easily determined by design.

It will be readily apparent to those skilled in the art that various modifications may be made and other embodiments implemented without departing from the scope of the invention concept.

Figure 4D:
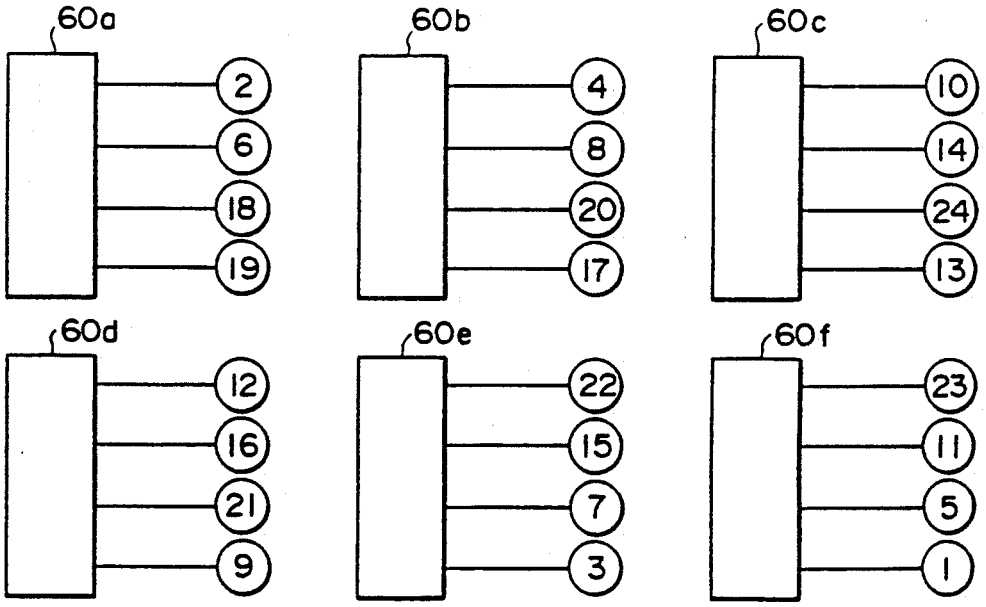

For example, in the embodiment described above, each transistor of the same transistor array is methodically connected to each solenoid. However, as shown in FIG. 4D, even they are connected without methodicalness, when each transistor in the same transistor array is connected to each solenoid which is not adjacently disposed, the same effects as the above embodiment may be obtained.

As was apparently described above, since an excessive load is shared to many transistor arrays, the present invention provides a solenoid driving circuit of a printer which operates safely and for a long time.

What is claimed is:

1. In a printing head, which is employable in a printer, having a predetermined number of printing pins respectively connected to solenoids circularly disposed along a predetermined circle, said solenoids being arranged to be connected to another predetermined number of transistor arrays respectively, each of said transistor arrays comprising a package including a third predetermined number of transistors;

the improvement in that one group of two solenoids adjacently located with each other along said predetermined circle are respectively connected to separate transistor arrays.

2. In a printing head, which is employable in a printer, having a predetermined number of printing pins respectively connected to solenoids circularly disposed along a predetermined circle, said solenoids being arranged to be connected to another predetermined number of transistor arrays respectively, each of said transistor arrays comprising a package including a third predetermined number of transistors;

the improvement in that two solenoids adjacently located with each other along said predetermined circle are respectively connected to separate transistor arrays;

wherein the following equation is satisfied among said predetermined number, said another predetermined number and said third predetermined number, $$k = N/n$$

where,

N is said predetermined number, n is said another predetermined number, and k is said third predetermined number.

3. In a printing head, which is employable in a printer, having a predetermined number of printing pins respectively connected to solenoids circularly disposed along a predetermined circle, said solenoids being arranged to be connected to another predetermined number of transistor arrays respectively, each of said transistor arrays comprising a package including a third predetermined number of transistors;

the improvement in that two solenoids adjacently located with each other along said predetermined circle are respectively connected to separate transistor arrays;

wherein said predetermined number is 24, wherein said anothe predetermined number is 6, and wherein said third predetermined number is 4.

4. The printing head according to claim 1, wherein said third predetermined number of alternating solenoids along said predetermined circle are connected to one of said transistor arrays.

5. The printing head according to claim 3, wherein every sixth solenoids along said predetermined circle are connected to one of said transistor arrays.

6. The printing head according to claim 3, wherein every third solenoids along said predetermined circle are connected to one of said transistor arrays.

7. A printing device comprising a printing head including a predetermined number of printing pins arranged to be respectively connected to solenoids circularly disposed along a predetermined circle, said solenoids being arranged in such a manner that any group of at least two adjacently located solenoids are respectively driven by transistors included in separate transistor arrays selected from another predetermined number of transistor arrays, each of said transistor arrays respectively comprising a package including a third predetermined number of transistors.

8. The printing device according to claim 7, wherein the following equation is satisfied among said predetermined number, said another predetermined number and said third predetermined number, $$k=N/n$$

where,

N is said predetermined number, n is said another predetermined number, and k is said third predetermined number.

9. The printing device according to claim 7, wherein said predetermined number is 24, wherein said another predetermined number is 6, and wherein said third predetermined number is 4.

10. The printing device according to claim 7, wherein said third predetermined number of alternating solenoids along said predetermined circle are connected to one of said transistor arrays.

11. The printing device according to claim 9, wherein every sixth solenoids along said predetermined circle are connected to one of said transistor arrays.

12. The printing device according to claim 9, wherein every third solenoids along said predetermined circle are connected to one of said transistor arrays.

13. A printing head including a predetermined number of printing pins arranged to be respectively connected to solenoids circularly disposed along a predetermined circle, said solenoids respectively being structured as comb shaped teeth around which solenoid coils are wound, said solenoids being arranged in such a manner that any group of two adjacently located solenoids along said predetermined circle are respectively driven by transistors included in separate transistor arrays selected from another predetermined number of transistor arrays, each of said transistor arrays respectively comprising a package including a third predetermined number of transistors.

14. A driving circuit for driving solenoids being adjacently arranged in a predetermined manner, said circuit comprising:

a plurality of transistor arrays respectively having a package provided with a plurality of transistors, said transistors included in said plurality of transistor arrays driving respective solenoids, wherein any adjacently arranged two solenoids are connected with separate transistor arrays.

15. The driving circuit according to claim 14, wherein said solenoids are circularly arranged.

16. The driving circuit according to claim 14, wherein said transistor arrays have the same number of transistors, respectively.

17. The driving circuit according to claim 14, wherein said solenoids are connected to said transistor arrays in a non-random relationship.

* * * * *